US006250792B1

(12) United States Patent
Krush et al.

(10) Patent No.: US 6,250,792 B1
(45) Date of Patent: Jun. 26, 2001

(54) INTEGRATED VIBRATORY ADAPTER DEVICE FOR PROVIDING MULTI-FREQUENCY OSCILLATION OF A VIBRATABLE WORKING UNIT

(75) Inventors: Iona Krush, Nesher; Yuri Obodan, Beer Sheva; Leonid Shifrin, Yehud, all of (IL)

(73) Assignee: Vibtec Engineering Ltd. (IL)

( * ) Notice: Subject to any disclaimer, the term of this patent is extended or adjusted under 35 U.S.C. 154(b) by 0 days.

(21) Appl. No.: 09/331,017

(22) PCT Filed: Dec. 15, 1997

(86) PCT No.: PCT/IL97/00409

§ 371 Date: Jun. 15, 1999

§ 102(e) Date: Jun. 15, 1999

(87) PCT Pub. No.: WO98/26863

PCT Pub. Date: Jun. 25, 1998

(30) Foreign Application Priority Data

Dec. 15, 1996 (IL) ..... 119836

(51) Int. Cl.[7] ..... B01F 11/00
(52) U.S. Cl. ..... 366/128; 74/87
(58) Field of Search ..... 366/108, 110–112, 366/114, 116, 120, 128; 74/86–87

(56) References Cited

U.S. PATENT DOCUMENTS

| | | | |
|---|---|---|---|
| 2,439,219 | | 4/1948 | O'Connor . |
| 3,468,418 | | 9/1969 | Renner . |
| 4,424,718 | | 1/1984 | Wadensten . |
| 4,425,813 | | 1/1984 | Wadensten . |
| 4,619,532 | * | 10/1986 | Schmidt, III ..... 366/128 |
| 4,859,070 | | 8/1989 | Musschoot . |
| 4,891,190 | | 1/1990 | Carter et al. . |

FOREIGN PATENT DOCUMENTS

1821370 A1 6/1993 (SU) .

OTHER PUBLICATIONS

"General Kinematics", Bulletin No. 580–A.
"Impact Vibrators", Vibratory Drives, Bin Discharge Aids and Slides, AEG, Vibration Engineering.

* cited by examiner

*Primary Examiner*—Charles E. Cooley
(74) *Attorney, Agent, or Firm*—George T. Mareou; Kilpatrick Stockton LLP

(57) ABSTRACT

An integrated vibratory adapter device for providing multi-frequency oscillation of a vibratable working unit, includes a working member associated with the working unit so as to be in force transmissive relation therewith; centrifugal vibratory apparatus for generating a single frequency sinusoidal vibration; rigid impact apparatus arranged to receive a single frequency sinusoidal vibration from the vibratory apparatus; resilient mounting apparatus for mounting the rigid impact apparatus in motion transmitting association with the working member and which is operative, when the vibratory apparatus is operated, so as to vibrate the rigid impact apparatus such that it transmits vibration forces to the working member; and one or more elastic buffers spaced between the rigid impact apparatus and the working member such that, when the vibratory apparatus is operated, the rigid impact apparatus elastically strikes the working member through the one or more elastic buffers such that the rigid impact apparatus transmits a continuous sequence of mechanical shock pulses to the working member, so as to cause multi-frequency oscillation thereof, thereby also to cause multi-frequency oscillation of the working unit.

16 Claims, 12 Drawing Sheets

FIG.13A
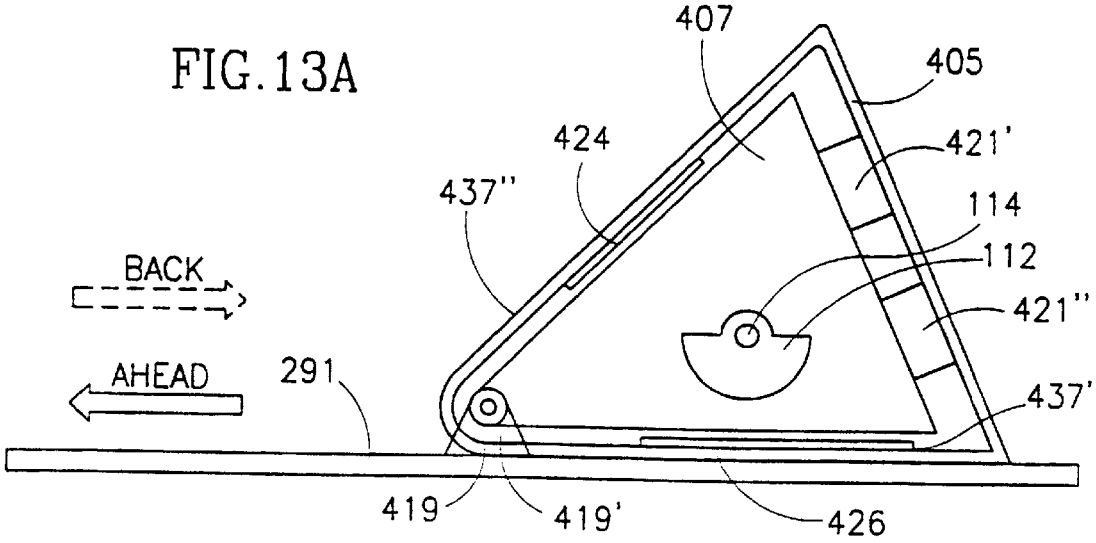
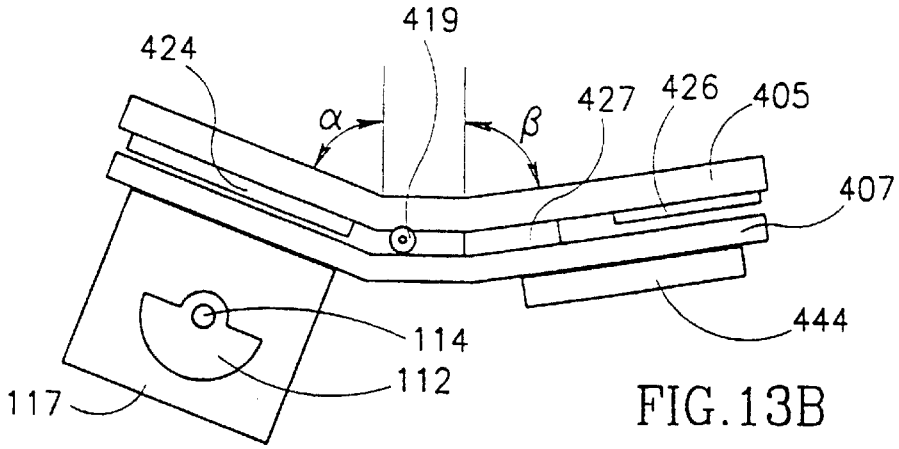
FIG.13B
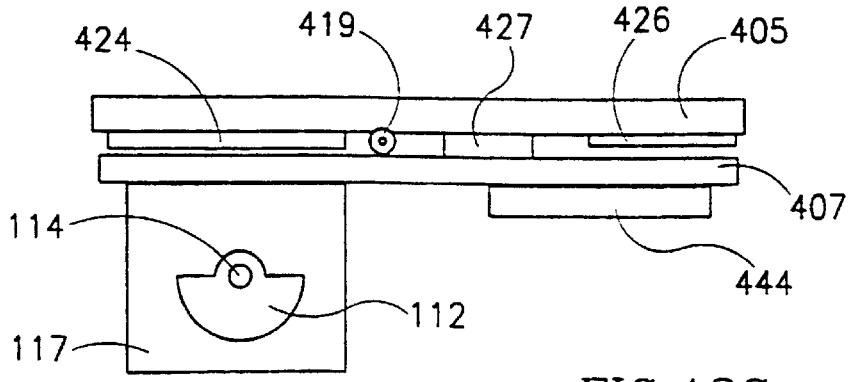
FIG.13C

INTEGRATED VIBRATORY ADAPTER DEVICE FOR PROVIDING MULTI-FREQUENCY OSCILLATION OF A VIBRATABLE WORKING UNIT

FIELD OF THE INVENTION

The present invention relates to the field of vibratory machines in general, and, in particular, to multifrequency adapters for vibratory processing equipment.

BACKGROUND OF THE INVENTION

Vibratory machines have been well known for many years for a large number of different uses, including screening of cohesive powder and sticky materials, compacting of concrete mixtures and powders, tamping of soil and asphalt, shaking-out of molds and casting, crushing, milling and mixing power of powders, deburring and finishing of casting with intricate shaping, and bin activation. Such machines further find application in a plurality of fields, including the construction industry, manufacture of building materials, processing of raw materials, mining, metallurgy, mechanical engineering, foundry associated applications, manufacture of ceramics and powders, the food industry, pharmaceuticals and chemicals.

Numerous different types of unbalanced vibrator units employing rotating shafts and eccentrically fixed weights, are utilized to drive these vibratory machines and devices. In particular, it is common to find unbalanced vibration motors or vibrators with external drive motors, used to drive different vibratory machines, which are supported on "soft" elastic mounts. The natural frequencies of these over-tuned machines are essentially less than the forced frequency of the vibrator units driving them, and such vibration units do not require adjustment or tuning. These vibrator units are supplied on the market as "ready-made" replaceable assemblies, such that use and service of such units are simple, relatively cheap and convenient.

It is known, however, that the required excitation forces in over-tuned machines must be large, causing great bearing losses and a waste of energy. Another disadvantage for many applications is the fact that they require multifrequency waveforms, rather than the single-frequency sine waveforms generated by an unbalanced vibrator. These applications include vibrator compacting, crystallization, screening, grinding, mixing, and so on, and require a member of harmonics with different frequencies and amplitudes, such as disclosed in U.S. Pat. No. 4,891,190 to Carter and U.S. Pat. No. 4,859,070 to Musschoot.

Also known are vibratory machines in which an unbalanced vibrator unit has an additional weight which is connected to a vibratory device by means of elastic constraints, thereby to provide tuned vibration and to increase the amplitude of the vibratory device under a non-varying single-frequency excitation force. One known form of an unbalanced vibrator unit of this type is used in the "Carriage Mounted Vibrating Charge Feeder," which is shown on page 7 of the Bulletin No. 580-A of the General Kinematics Corporation, entitled "Vibrator process equipment for the cost efficient foundry", published in 1992. These tuned machines undoubtedly save energy when compared with similar, non-tuned machines. However, machine working modes can be sensitive to loading such that, if the working load changes a tuning adjustment may be required. A further disadvantage of these machines is the provision of a single frequency motion of the working unit, which is inherently non-optimal, as discussed above.

There is also known a vibratory machine of another type, which employs a working unit supported by elastic mounts, an impact member with a fixedly attached unbalanced vibrator, and a plurality of elastic shear elements an buffers provided between the impact member and working unit. A harmonic force of the unbalanced vibrator excites the impact member and, due to repeated collisions of the impact member with the elastic buffers, the harmonic force is transformed into a multi-frequency force. This multi-frequency force is conducted to the working unit of the vibratory machine.

A vibrator unit of this type is described in conjunction with a vibration-impact table for mold compaction of concrete mix in USSR Patent No. 1821370. A multifrequency vibration machine of this type has a number of advantages, including the provision of an optimal waveform, high work efficiency and energy saving in comparison to over-tuned machines. The present inventors have found that the use of multi-frequency machines such as described in the above-reference USSR patent facilitates a 75% reduction in the required power input to the drive. A machine of this type, furthermore, costs about half of the cost of an over-tuned machine as described above.

This type of machine is characterized, however, by a temperature instability of the elastic shear elements associated with the impact member, which can lead to a failure, both of these elements and of the machine as a whole. Another shortcoming is the rapid irregular wear of the buffers' surfaces as the result of elliptic trajectories of the impact member relative to the working unit, and resulting skewed impacting of the buffers' surfaces. Both of these disadvantages result in necessary frequent adjustment or tuning of the machine by skilled personnel. Turning in industrial conditions is very labor-consuming and requires special equipment.

Impact vibrator units, which contain electromagnetic vibrators and special adapters, are shown in an article entitled "Vibrations and Schweisstechnik", published by the AEG Actiengesellchaft Company. Such vibrator units are intended for impact activation of the wall of a bin by means of directly acting electromagnetic vibrators. An adapter, provided as a separate unit, includes rubber elements and an impact bolt, which are operative to transfer vibrational forces and unilateral impact impulses to the bin wall, thereby activate bulk material flow.

Disadvantages of this vibrator drive unit include its low power of less than 0.5 kW, and an absence of a force component normal to the impact direction. Both disadvantages are inherent in electromagnetic excitation.

SUMMARY OF THE INVENTION

The present invention aims to provide a multifrequency adapter for vibrator processing equipment based on standard centrifugal single-frequency vibration exciters.

A further aim of the present invention is to provide a vibrator drive unit for generation of a vibration exciting force of different predetermined magnitudes, in predetermined directions and of predetermined waveforms.

In particular, the present invention aims to provide a multifrequency vibrator adapter which is characterized by providing increased throughput by quickening the vibration processing of material and objects; generation of a continuous or a discrete wide-band spectrum vibration ensuring optimal action on particulate media and processed items.

The present invention aims further to provide a multifrequency adapter which provides single-frequency to multifrequency spectrum transformation which is further characterized by a reduced energy losses in bearings, improved reliability, and a decrease in required excitation forces and drive power due to the use of resonant phenomena.

It will further more be appreciated that the adapter of the present invention does not require significant changes in the design of vibration machines.

There is thus provided, in accordance with a preferred embodiment of the invention, an integrated vibratory adapter device for providing multi-frequency oscillation of a vibratable working unit, which includes:

a working member rigidly attachable to the working unit;

centrifugal vibratory apparatus for generating a single frequency sinusoidal vibration;

rigid impact apparatus arranged to receive a single frequency sinusoidal vibration from the vibratory apparatus; and resilient mounting apparatus for mounting the rigid impact apparatus in motion transmitting association with the working member and which is operative, when the vibratory apparatus is operated so as to vibrate the rigid impact apparatus such that it transmits vibration forces to the working member so as to cause multi-frequency oscillation thereof, thereby also to cause multi-frequency oscillation of the working unit.

Additionally in accordance with a preferred embodiment of the invention, the rigid impact apparatus includes a generally planar rigid impact portion, and the device further includes elastic buffer apparatus, and wherein the resilient mounting apparatus includes apparatus for mounting the rigid impact apparatus such that the planar rigid impact portion thereof is spaced apart from the working member, and wherein the buffer apparatus is arranged between the working member and the planar rigid impact portion so as to transfer oscillation forces from the impact apparatus to the working member.

Further in accordance with a preferred embodiment of the invention, the vibratory apparatus is connected to the impact apparatus via a rigid housing which is operative to transfer the single frequency sinusoidal vibrations to the impact apparatus.

Additionally in accordance with a preferred embodiment of the invention, the working member forms part of a rigid base assembly having rigid wall portions extending transversely therefrom, and the resilient mounting apparatus includes at least a pair of resilient members located between and connected to the rigid wall portions and the rigid impact apparatus, so as to support the impact apparatus in a floating mounting relative to the working member so as to permit motion of the impact apparatus having generally forward and rearward components with respect to the working member.

Further in accordance with a preferred embodiment of the invention, the resilient members are of predetermined stiffness which permits predetermined vibration of the impact apparatus, and wherein the adapter device further includes apparatus for preventing overheating of the resilient members.

Additionally in accordance with a preferred embodiment of the invention, the impact apparatus is operative to impact the working member via the elastic buffer apparatus when moving in a direction having a generally forward motion component, and is further operative to move away from the working member when moving in a direction having a generally rearward motion component, and the apparatus for preventing overheating includes apparatus for limiting rearward motion of the impact apparatus.

Further in accordance with a preferred embodiment of the invention, the rigid base assembly further includes a base portion rigidly connected to the rigid wall portions and generally parallel to the working member, and the elastic buffer apparatus includes forward buffer apparatus, and wherein the apparatus for preventing overheating includes rearward elastic buffer apparatus arranged between the impact apparatus and the base portion for elastically limiting the rearward motion component of the impact apparatus.

Additionally in accordance with a preferred embodiment of the invention, the pair of resilient members are operative to partially resist the forward and rearward motion components of the impact apparatus, preferably, in shear.

Further in accordance with a preferred embodiment of the invention, the resilient members include precompressed elastic portions having a much lower shear stiffness in shear planes generally parallel to the forward and rearward motion components of the impact apparatus than normal thereto, preferably no more than one twentieth thereof.

BRIEF DESCRIPTION OF THE DRAWINGS

The present invention will be more fully understood and appreciated form the following detailed description, taken in conjunction with the drawings, in which:

FIGS. 13A–13C are cross-sectional schematic views of various further embodiments the invention, employing a combination of silent blocks and flat shear rubber elements.

DETAILED DESCRIPTION OF THE INVENTION

Figure 1:
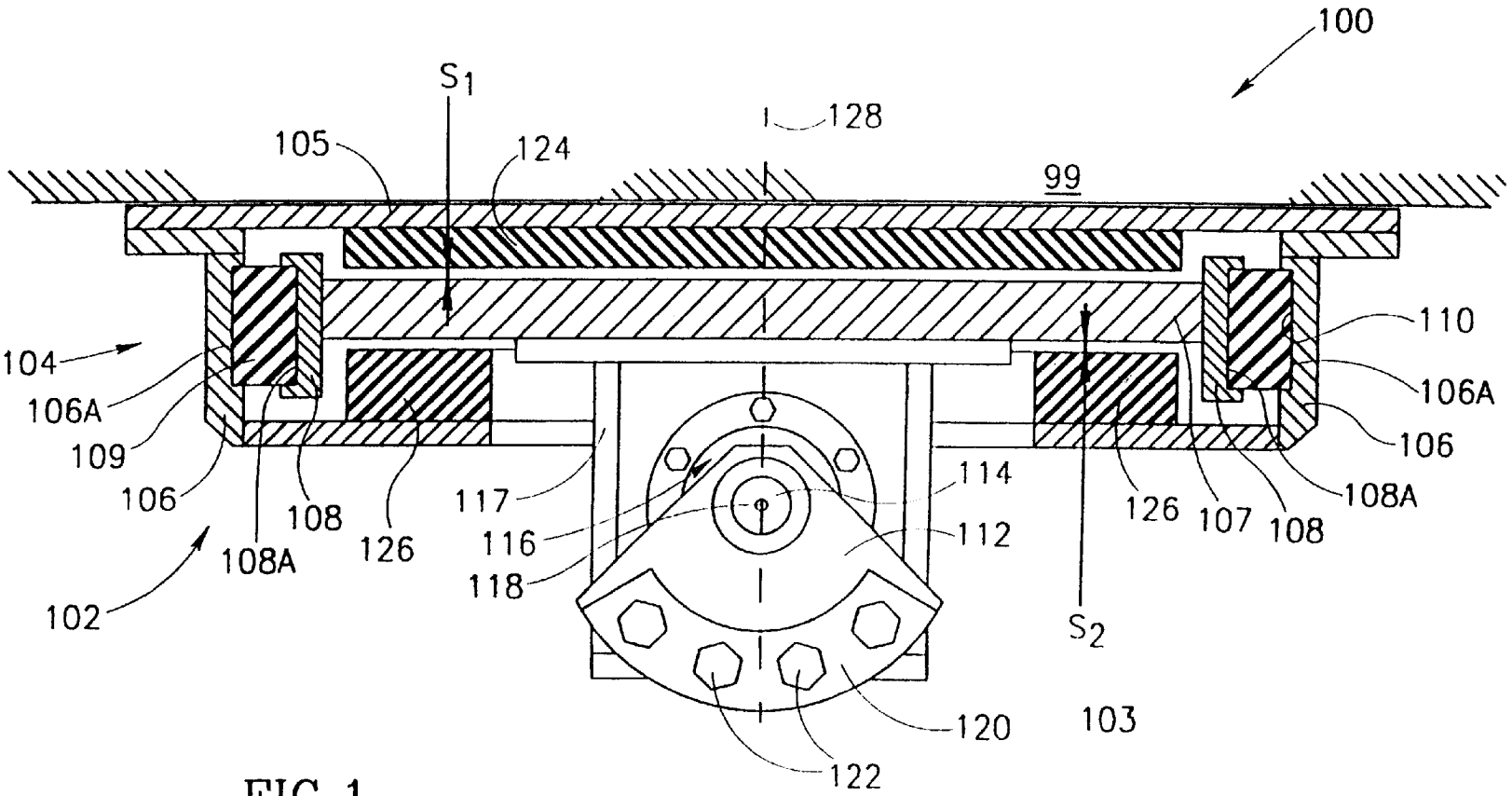
FIG. 1 is a schematic view of a multi-frequency vibrator adapter unit constructed in accordance with a first embodiment of the present invention.

Referring now to FIG. 1, there is shown, in partially cut-away front elevation, a multifrequency vibrator adapter unit, referenced generally 100, constructed in accordance with a first embodiment of the present invention. Unit 100 is configured for attachment to a portion 99 of a vibratable working unit, which may be any type of vibratory device for uses such as screening of cohesive powder and sticky materials, compacting of concrete mixtures and powders, tamping of soil and asphalt, shaking-out of molds and casting, crushing, milling and mixing of powders, deburring and finishing of casting with intricate shaping, bin activation, and so on.

The vibrator unit 100 has a multi-frequency adapter assembly, reference generally 102 and an unbalanced vibrator assembly, reference generally 103. Adapter assembly 102 includes a rigid base assembly, reference generally 103. Adapter assembly 102 includes a rigid base assembly 104, and a rigid impact member 107. In the present embodiment, base assembly 104 has a rigid working member 105 from which extend a pair of downwardly extending flange portions 106, each portion 106 having formed therein a generally inward-facing cutout 106*a*.

Working member 105 is attached by any suitable fastening means (not shown) to the portion 99 of vibratable working unit, and in force transmissive relation therewith, so as to transmit thereto excitation forces generated by adapter unit 100.

It should be noted that in the further embodiments of the invention shown and described hereinbelow in conjunction with FIGS. 2–14B, neither a vibratable working unit nor any portion thereof is necessarily shown, although such is taken to be present in the same or a similar manner in which it is shown and described in conjunction with the present embodiment.

Adapter Impact member 107 has a pair of end portions 108 each having formed therein a generally outward-facing cutout 108*a*. Impact member 107 is connected to base assembly 104 by a pair of elastic shear elements 109 and 110, each of which is located in a pair of opposing cutouts 106*a* and 108*a*, which are operative to suspend impact member 107 in a "soft" or "floating" mounting between downwardly extending flange portions 106, in an at-rest orientation generally parallel to working member 105.

Unbalanced vibrator assembly 103 includes a weight 112 which is eccentrically mounted onto a drive shaft 114. Drive shaft 114 is supported by bearings 116 for rotation about its axis 118. Bearings 116 are mounted, in any suitable manner, within a rigid housing 117, which is rigidly attached to impact member 107. It will thus be appreciated that any vibratory motion induced by rotation of weight 112 together with shaft 114 is transmitted directly to impact member 107. An additional weight 120 may be attached to the eccentric weight 112, as via bolts 122, so as to increase the magnitude of the centrifugal force exerted on shaft 114 during rotation thereof.

Drive shaft 114 is driven by a motor (not shown) via a suitable elastic coupling (also not shown), generally as known in the art. There are also provided an upper elastic buffer 124, located between working member 105 and impact plate 107 for transmitting 'forward' or upward impacts to working member 105; and lower elastic buffer 126, located between impact plate 107 and flange portions 106 of base assembly 104, for cushioning the impact of 'reverse' movements of working member 105. Lower elastic buffer 126 is fastened to base assembly 104 and has an axis of symmetry 128 which cuts shaft 118 at right angles; the axis 128 being generally perpendicular to working member 105. The geometry of adapter assembly 103, base assembly 104 and buffers 124 and 126 is such that impact member 107 lies between buffers 124 and 126 so as to be spaced therefrom when at rest, the space between upper buffer 124 and impact member 107 is a predetermined spacing "$s_1$", and the space between lower buffer 126 and impact member 107 is a predetermined spacing "$s_2$".

It will be appreciated by persons skilled in the art that the adapter unit of the present invention may have either a generally horizontal orientation, or an inclined orientation, as desired. Accordingly, the present embodiment of the invention is described herein in terms of a generally horizontal orientation, and that the terms "upper" and "lower" should thus be understood in this exemplary context only.

The elastic shear elements 109 and 110 are pre-compressed and mounted as described above. The relative pre-compression of the elements 109 and 110 after assembly of adapter assembly 102, in a direction normal to axes 118 and 128, is in the range 2–30%. Pre-compression of elastic shear elements 109 and 110 within this range provides a required compression force which prevents loosening of impact plate 107 during operation.

Elastic buffers 124 and 126 are characterized by a normal stiffness to shear stiffness ratio of greater than 20. This is necessary in order to prevent both loosening of the buffers and excessive wear of their surfaces when in repeated skew collisions with impact member 107.

In accordance with a further embodiment of the invention, elastic buffers 124 and 126 may alternatively be fastened, as by bolting, bonding, and so on, to the impact member 107, such that the gaps $s_1$ and $s_2$ are formed between the working member 105 and the elastic buffers. Moreover, without limitations, one of elastic buffers can be connected to the base member and another buffer to the impact member. As a further alternative, the buffers may be allowed to "float" in the gap between the base member and the impact member.

In operation, vibrations in unbalanced vibrator assembly 103 are generated by rotation of shaft 114 together which is eccentrically mounted weight 112 and optional additional weight 120. This rotation gives rise to a known centrifugal force which is transmitted at a known 'forced' frequency, to housing 117 and thus to the impact member 107. As described above, impact member 107 is suspended in a soft or floating mounting, via elastic shear elements 109 and 110. Accordingly, as the described centrifugal force—which is essentially a single frequency sinusoidal excitation—is transmitted to impact member 107, it undergoes a complex angular translation relative to working member 105. This results in a complicated trajectory of the impact member and further causes repeated skewed elastic collisions of the impact member 107 with upper elastic buffer 124 and with lower elastic buffer 126, thereby leading to a multi-frequency periodic or random excitation of working member 105.

The time and force characteristics of the collision impacts between impact member 107 and upper and lower buffers 124 and 126 are dependent upon parameters of excitation and system. Among main influencing parameters are:

the magnitude, frequency and rotation direction of the centrifugal force generated with vibrator assembly 103;

the weight and inertia moment of the vibrator assembly 103, and of impact member 107;

the normal and shear stiffness of the elastic shear elements 109 and 110 and of upper and lower buffers 124' and 126;

the magnitude of gaps $s_1$ and $s_2$; and relative geometric parameters of all the various components.

Elastic forces in elastic shear elements 109 and 110 and upper and lower buffers 124 and 126 result in a corresponding output excitation force of impact member 107 and thus also of working member 105, which can have a periodic or non-periodic time function, and has multi-frequency wide band Fourier spectrum due to repeated impact pulses, superposed on the main harmonic of forced frequency. Depending on the above mentioned parameters, the multi-frequency spectra can be discrete or continuous. In certain cases in which the gaps $s_1$ and $s_2$ are either very large or are absent and the buffers are precompressed, a single-frequency periodic vibration of the forced frequency may result.

It will thus be appreciated that adjustment of the vibrator assembly 103 gives a possibility of provided a preselected optimum output spectrum for different applications. While a fully assembled adapter unit 100 may be pre-tuned during initial assembly, a final tuning may be provided by the adjustment of the centrifugal force magnitude, i.e. by increasing or decreasing the weights on shaft 114, and by adjustment of gaps $s_1$ and $s_2$. Such tuning of the adapter unit can provide optimum excitation of the vibrator assembly 103 in accordance with requirements.

By way of example, an optimum application of the multi-frequency vibration in finishing processing requires a multi-frequency vibration of the working member 105 in a vertical direction and single frequency vibration in a horizontal direction. The vertical vibration contains a main harmonic in low frequency, for example, 25 Hz, with enlarged amplitude and a combination of high frequency harmonics resulting in acceleration peaks of up to 50 g. The main frequency vibration provides fluidization and mixing of the working medium together with the items processed. High acceleration and therefore high contact stresses intensify finishing processing. Furthermore, in conventional finishing processing different frequencies are required for processing different parts.

Use of the present invention obviates the need for prior art frequency converters for optimization of working mode, as any required frequency in discrete or continuous spectrum, generated by adapter unit 100, may be selected by appropriate tuning. Dynamic boosting of the vertical vibration, which can be adjusted by adjusting gaps $s_1$ and $s_2$, decreases necessary centrifugal force and energy consumption wasted on the bearings, thereby both to increase reliability and reduce energy consumption.

Furthermore, the provision of the lower buffer 126 allows increase reliability of the vibrator unit due to the temperature stability of the system.

By way of further explanation, it has been found by the Inventors that the presence of lower elastic buffer 126 impacts a desired temperature stability to the upper elastic buffer 124. This is due to the fact that, as the energy of the reverse stroke is partially absorbed by the lower buffer 126, an increase in the temperature of the elastic shear elements, due to a cyclic internal friction in rubber, and which is exacerbated under a high surrounding temperature, is prevented.

Conversely, an absence of lower elastic buffer 126 would lead to an overheating of elastic shear elements 109 and 110 and a consequent reduction in their stiffness, thereby causing an increase in the buffer gap $s_1$. This increase in the buffer gap $s_1$ causes an increase in stroke, thus causing yet a further increase in the temperature of the shear elements. It will be appreciated that this cyclic, self-perpetuating increase in temperature of the shear elements 109 and 110 during use of the vibrator unit would, in the absence of lower buffer 126, led to failure of the elastic shear elements 109 and 110 and a consequent breakdown of the vibration adapter unit.

In all embodiments of the present invention, the elastic buffers 124 and 126 can be rigidly connected to working member 105 and flange portions 106, respectively; they can be connected to the appropriate surfaces of impact member 107; or they can "float" in the gaps between the impact member 107 and base member 105 and working member 105.

Figure 2:
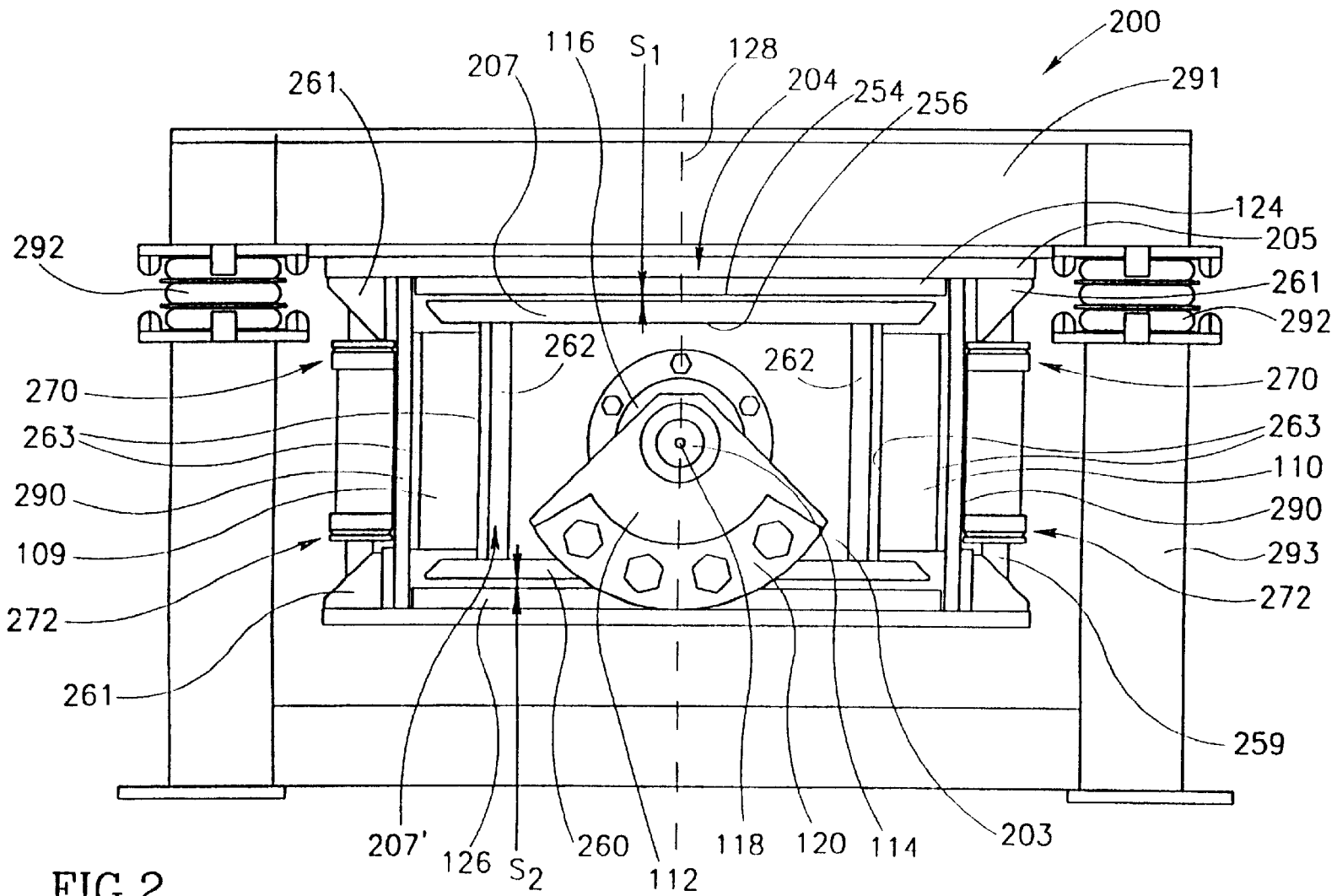
FIG. 2 is a front elevational view of a multi-frequency vibrator adapter unit constructed in accordance with a second embodiment of the present invention.
Figure 3:
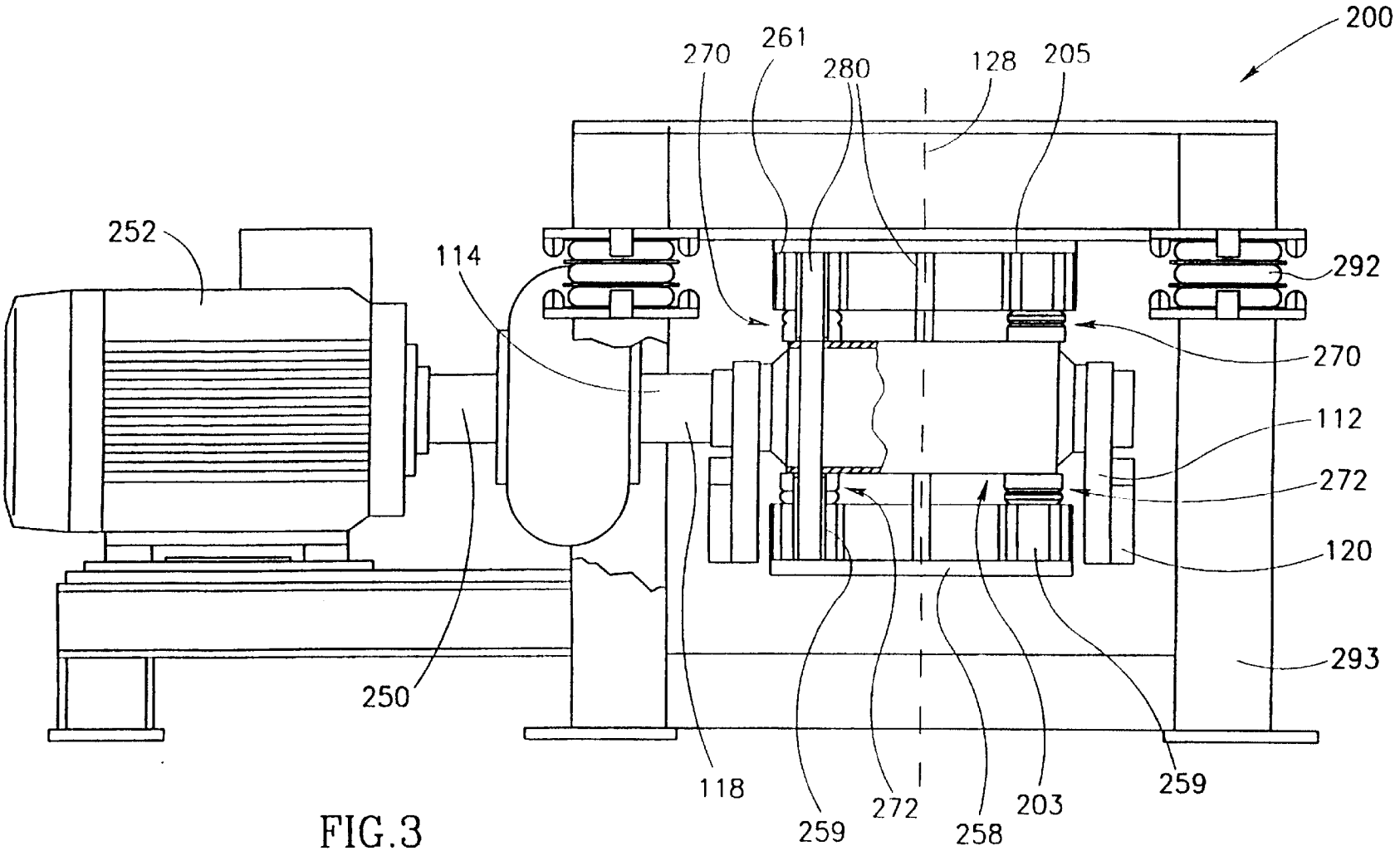
FIG. 3 is a pictorial side view of the unit seen in FIG. 2, and employing an external drive.

Referring now to FIGS. 2 and 3, there is shown a multi-frequency vibrator adapter unit, reference generally 200, constructed in accordance with a second embodiment of the present invention. The general layout and principles of operation of unit 200 are generally similar to those of unit 100, shown and described in detail hereinabove in conjunction with FIG. 1. Accordingly, portions of unit 200 having counterpart portions in unit 100 are in many cases labeled with the reference numerals seen in FIG. 1, and are not specifically described again in conjunction with FIGS. 2 and 3, unless required for the understanding of the embodiment shown therein.

In accordance with the present embodiment, adapter unit 200 includes a multi-frequency adapter assembly having an impact frame assembly 207' and a base assembly 204, both of which are formed as rectangular parallelepipeds; impact assembly 207' being accommodated within the base assembly 204. Adapter unit 200 is fastened to a vibration table 291 which is supported by resilient rubber member 292 on a fixed frame 293. The axis 118 of drive shaft 114 and an axis 250 of an external motor 252 (FIG. 3) are aligned perpendicular to axis 128 and parallel to surface 254 of buffer 124.

In the present embodiment, base assembly 204 includes working member 205, a lower base plate 258, and lateral connector portions 259 which serve to rigidly connect working member 205 to lower base plate 258. Impact frame 207', which is supported generally within base assembly 204, includes impact member 207, a lower plate member 206 which is rigidly connected to impact member 207 by rigid ties 262.

The elastic shear elements 109 and 110 are accommodated between the impact member 207 and lateral wall portions 290 of the base frame 205. Corner bracing members 261 are provided so as to laterally confine wall portions 290 and thus working member 205 and the lower base plate 258. Working member 205 and lower base plate 258 are connected to each other via studs 280 which are accommodated inside connector portions 259. Preferably, these connections are adjustable bolted connections, thereby enabling adjustment of the gap $s_1$ between the impact member and the upper buffer 124, and of the gap $s_2$ between lower buffer 126 and lower plate member 260.

The upper elastic buffer 124 is arranged between working member 205 and impact member 207, and the lower elastic buffer 126 is arranged parallel to upper elastic buffer 124, and between lower base plate 258 and lower plate member 260. Elastic shear elements 109 and 110 are similar in configuration to their counterpart elements in unit 100 (FIG. 1), and are supported between and in a normal orientation to lower base plate 258 and impact member 207, by any suitable construction, substantially as shown.

In the present embodiment, upper elastic buffer 124 is attached, by way of example, to a lower face of working member 205, and impact member 207 is supported such that there is defined gap $s_1$ between the impact member and the upper buffer 14. Similarly, lower elastic buffer 126 is attached to lower base plate 258, and there is defined gap $s_2$ between lower buffer 126 and lower plate member 260.

During assembly of the working member 205, lower plate member 258, lateral connectors 259 and bracing members 261, the elastic shear elements 109 and 110' are mounted in position and subsequently compressed by a predetermined amount, substantially as described herein.

As seen schematically in FIGS. 2 and 3, lateral connector portions are preferably also provided with upper and lower adjustment elements, respectively referenced 270 and 272. These adjustment elements, which may be, for example, threaded members, serve to permit setting and adjustment of both the upper and lower gaps $s_1$ and $s_2$.

Gaps $s_1$ and $s_2$ are preselected in accordance with a required tuning of the vibrator unit, and in accordance with certain limitations. Among these limitations are:

1. one of the gaps $s_1$ and $s_2$ must be less than the amplitude of the impact member 207 relative to working member 205 if either buffer were absent;
2. the sum of the gaps $s_1$ and $s_2$ must be less than the maximum stroke of the impact member, which itself is dependent upon the strength and permitted self-heating of the elastic shear elements.

In the present invention, vibrator assembly 203 is driven by means of an external drive, such as the external motor shown at 252 in FIG. 3

Figure 4:
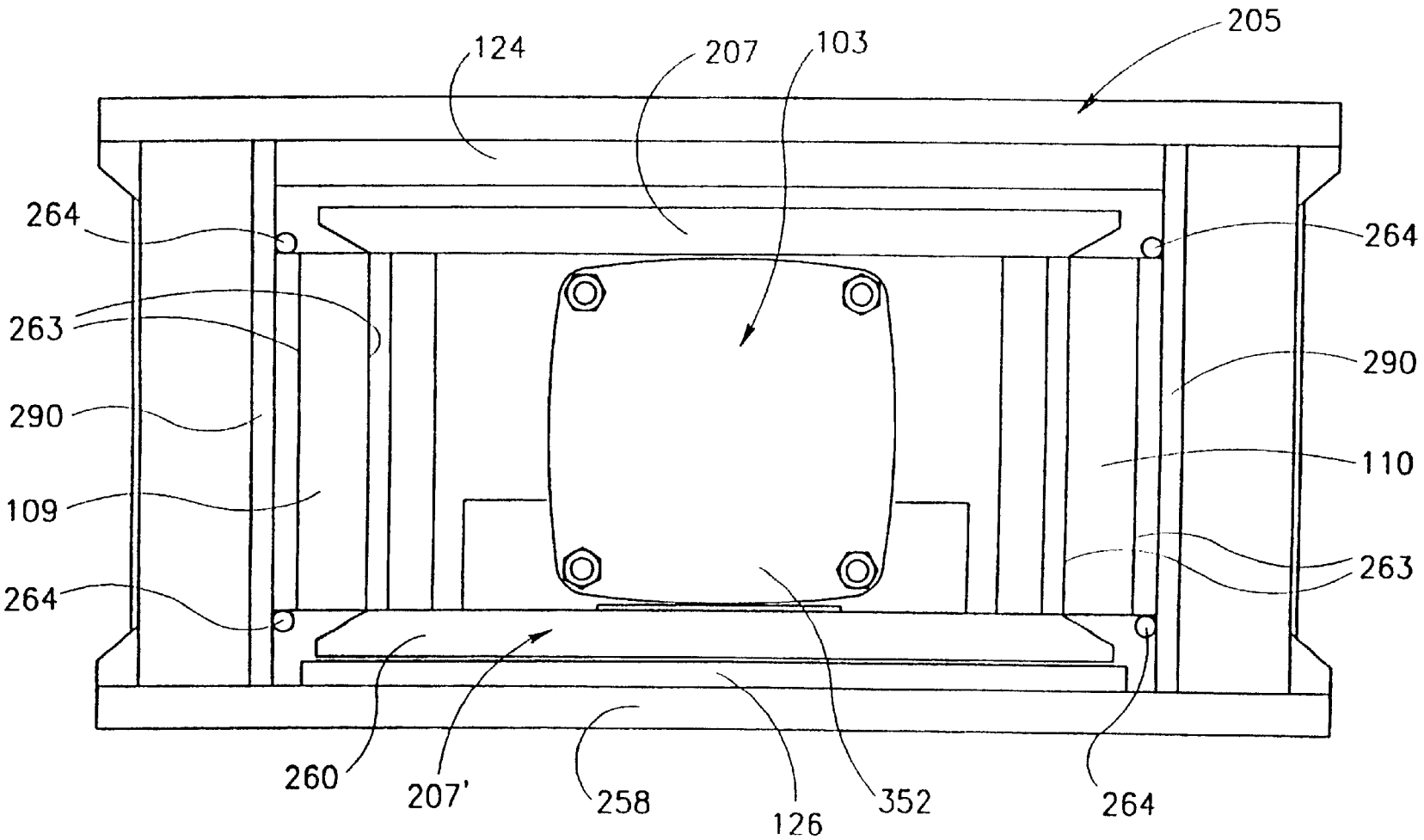
FIG. 4 is a pictorial front view of the unit seen in FIG. 2, and employing a vibrator motor as an internal drive.

Referring now to FIG. 4, however, there is shown an adapter assembly which is generally similar to the adapter assembly shown and described above in conjunction with FIG. 2, but which employs an internal vibratory motor 352 which is mounted within the impact frame 207 and which is fastened rigidly to lower plate member 260.

It will be appreciated that placement of the unbalanced vibrator within the impact frame 207, as shown and described above in conjunction with FIGS. 2 and 3; and placement of vibratory motor 352 within the impact frame 207', as shown and described above in conjunction with FIG. 4, provide a highly compact design of the multi-frequency vibrator adapter unit of the present invention, without associated constructive elements. Also, due to the compactness of the present adapter unit construction in comparison with prior art constructions, there is less of a tendency to generate parasitic moments in the system than in the prior art, and the weight of the units is also relatively low. Both of these characteristics increase the mechanical reliability of the present unit.

Referring now once more the FIGS. 2–4, elastic shear elements 109 and 110 are flat shear rubber elements having shear planes 263 normal to surface 254 of buffer 124 and surface 256 of impact member 207. Limiting members, such as those shown at 264 in FIG. 4, can be employed so as to prevent elastic shear elements 109 and 110 from shifting.

Elastic shear elements 109 and 110 are pre-compressed, and their compression stiffness in a direction normal to their shear planes is 6–300 times more than their shear stiffness. It is necessary to limit motion of the impact member 207 relative to the working member 205 in a horizontal direction, thereby to prevent skewed impacts between impact member 207 and buffers 124 and 126, which would cause intense wear of the buffers.

One way in which it is possible to assemble the adapter, constructed as per the embodiment of FIG. 2, is by the provision of an opening in the lateral walls of the base member of the adapter.

Figure 7:
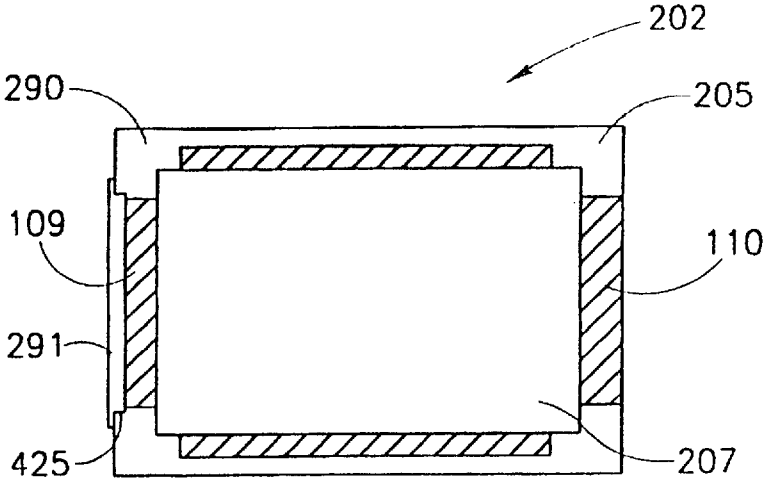
FIG. 7 is a schematic side view an impact member and lateral walls of a base assembly of a vibrator unit according to the invention, containing windows in the base member for placement and fixing of the elastic shear elements.

In particular, and referring now also to FIG. 7, it is seen that the multi-frequency adapter 202, formed in the shape of a rectangular parallelepiped, has an opening 425 formed in lateral wall 290 for insertion of elastic shear element 109. Initially, prior to mounting of impact member 207 in base member 205, shear element 110 is inserted in position, as shown. Subsequently, after impact member 207 has been inserted in position, shear element 109 is inserted through opening 425, and is mounted in touching contact with impact member 207. A rigid cover member 291 is then fastened to wall 290, by any suitable fastening means, so as to pre-compress shear element 109 between the cover member 291 and the impact member 207. The provision of opening 425 as described, facilitates adjustment of the degree of pre-compression of shear elements, and thus upgrading of the vibration unit.

Figure 5:
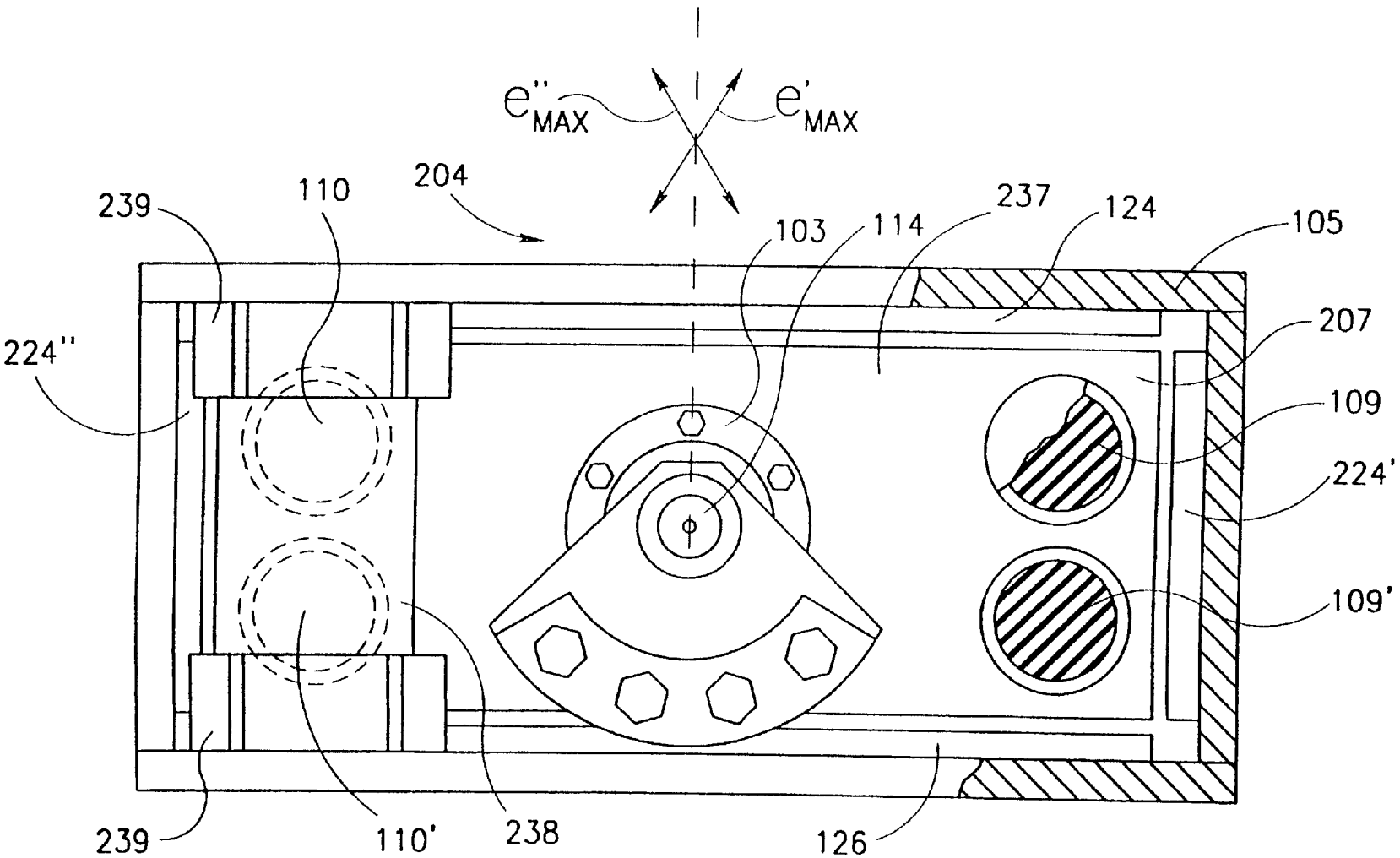
FIG. 5 is a partially cut-away front view of the multi-frequency adapter unit of FIG. 2, but employing elastic shear elements with planes of shear normal to the rotation axis of a drive shaft.
Figure 6:
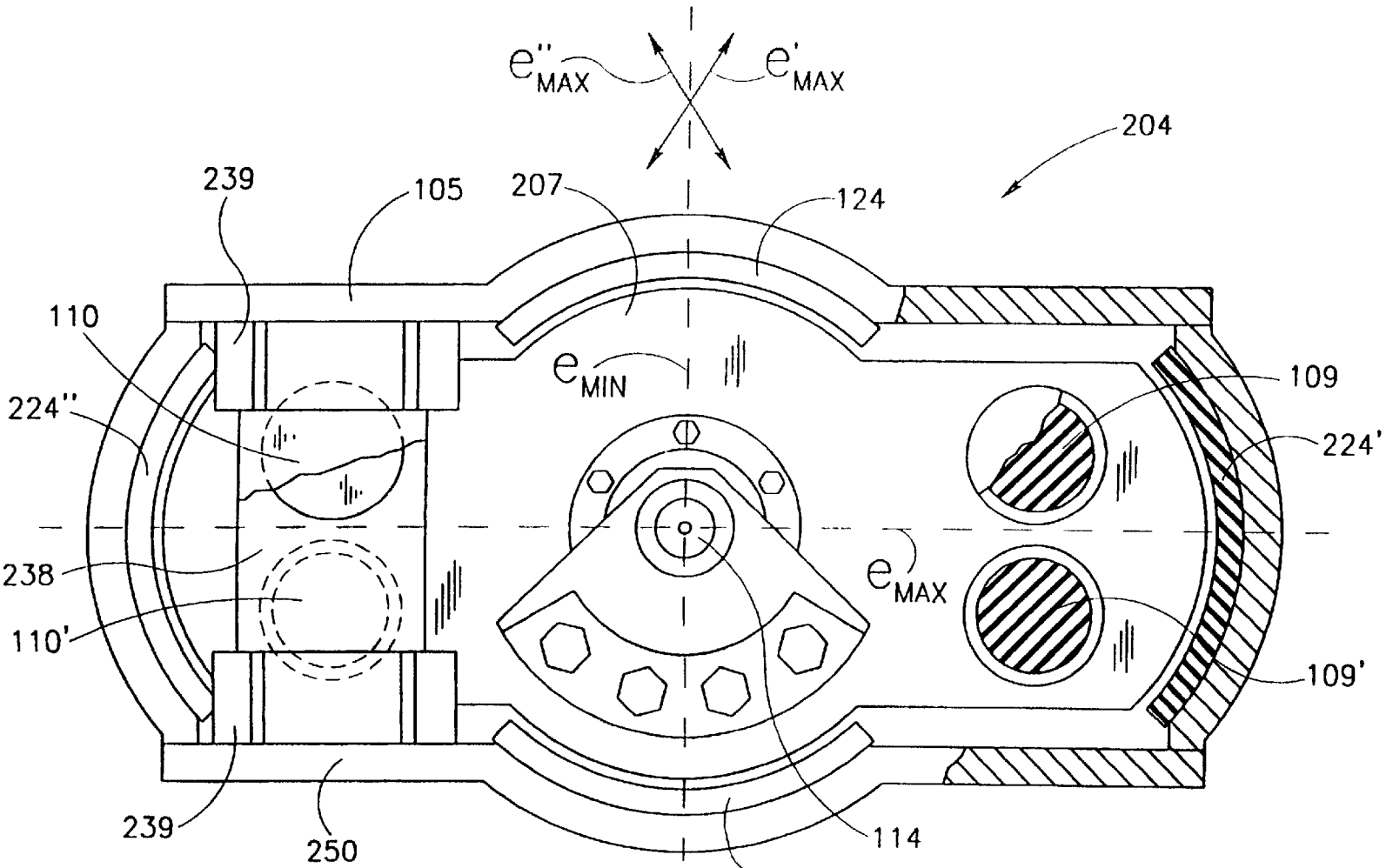
FIG. 6 is a partially cut-away side view of a multi-frequency adapter unit constructed in accordance with the present invention, and employing elastic buffer elements in accordance with a further embodiment of the invention.

Referring now to FIGS. 5 and 6, there are shown adapter units in accordance with yet a further embodiment of the invention. In these embodiments, impact member is mounted via cylindrical elastic shear elements 109, 109' 110 and 110", in a support construction which is formed of vertical support portions 238 mounted via bracing members 239. The shear planes of the shear elements are normal to the axle of the shaft 114. The shear elements are axially pre-compressed in the range 2–30%, and are mounted in a manner which is similar to that described above in conjunction with shear elements 109 and 110 (FIGS. 2 and 3). Lateral elastic buffers 224' and 224" are located between impact member 207 and working member 105 together with direct or upper elastic buffer 124 and reverse or lower elastic buffer 126.

This arrangement provides an elliptical trajectory of the working unit with a prescribed ratio of the elliptic axes, thus extending the capabilities of the vibration unit. In particular, for finishing and screening applications, where elliptical trajectories are proved to be optimum in machines employing an unbalanced vibrator with a vertical axis, the present embodiment is particularly useful, providing reliability and high processing efficiency. Additionally, the elliptical trajectory of the working unit when in operation may be changed so as to define either of major axes $e'_{maj}$ or $e''_{maj}$ by reversal of the rotation of the shaft 114, thus also reversing direction of vibrator transportation. This feature can give flexibility in ground pounders and conveying machines.

Figure 8A:
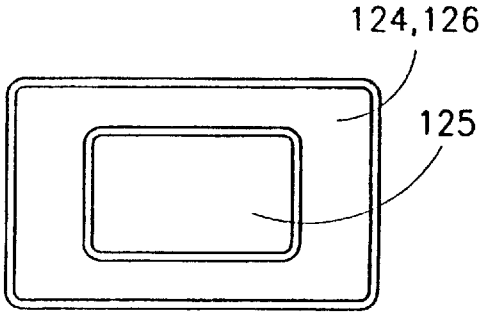
FIGS. 8A–8C are schematic plan views of elastic buffers formed in accordance with alternative embodiments of the invention.
Figure 8C:
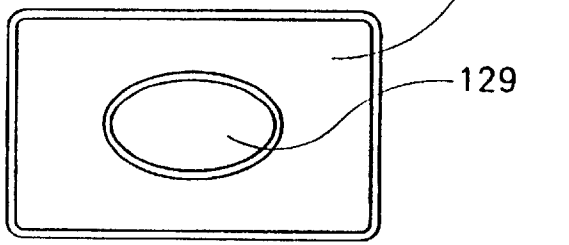
Figure 8B:
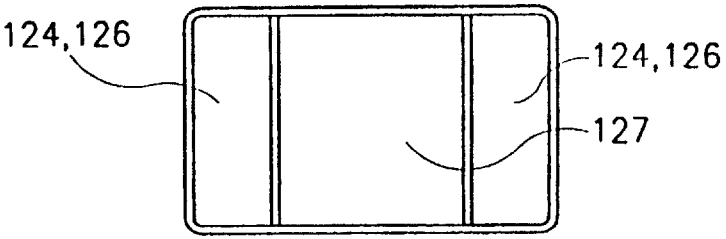

Referring now to FIGS. 2, 8, 8B and 8C, buffers 124 and 126 may be formed with openings or recesses therein. By way of example only, buffers 124 and 126 may have formed therein a rectangular opening or recess 125, as seen in FIG. 8A; they may have a central opening or recess 127, as seen in FIG. 8B; and they may have a generally round or elliptical opening or recess 129, as seen in FIG. 8C.

It will be appreciated that by provision of cavities or recesses of different shapes and depths, it is possible to provide buffers 124 and 126 of different varying stiffness and, at the same time, reducing the tendency of rotational vibration or "galloping" of the impact member. More precisely, "galloping" is an undesirable rotational vibration which accompanies a translational vibration. Galloping is known to decrease peak acceleration, leads to an instability in vibration and to a reduction in output of a vibrator device. When upper buffer 127 is provided with recesses or cavities as described, impact member 207 collides therewith in a desired manner, preventing galloping and thus increasing the stability of the multi-frequency vibration output of the vibrator device.

Figure 9A:
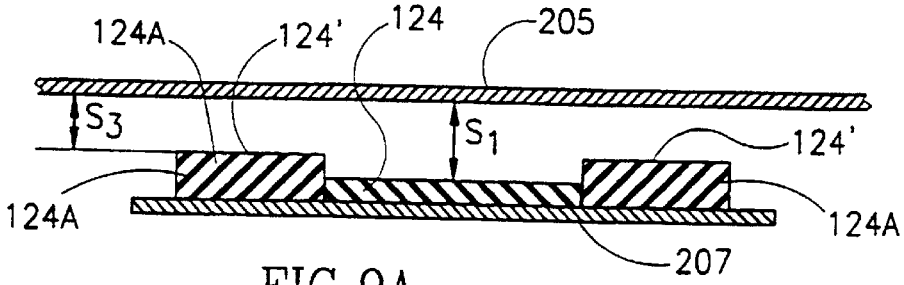
FIGS. 9A and 9B are cross-sectional views of elastic buffers having mounted therewith additional buffers of varying thicknesses.
Figure 9B:
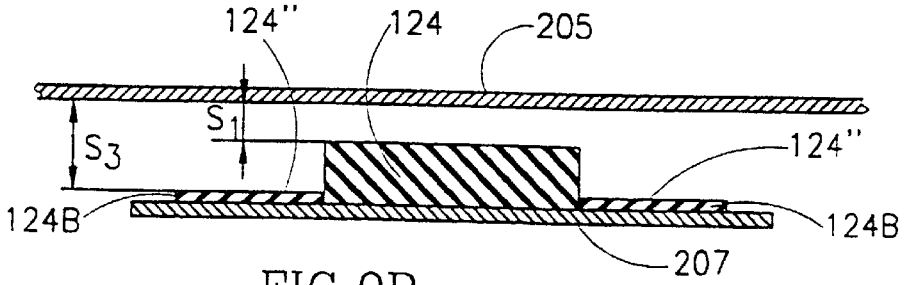

Referring now to FIGS. 9A and 9B, in a unit constructed in accordance with a further embodiment of the invention, there may be provided, as well as upper buffer 124, additional buffer members, referenced 124*a* (FIG. 9A) and 124*b* (FIG. 9B), between the upper buffer 124 and working member 205. As seen in FIG. 9A, the additional buffers 124*a* may be higher than buffer 124, so as to define a gap $s_3$ between a surface 124' of additional buffer 124*a* and working member 205, wherein $s_3<s_1$. This arrangement broadens the real frequency spectrum band due to the changing of the nonlinear characteristics of the restoring forces in the buffers versus the displacement thereof.

Alternatively, as seen in FIG. 9B, the additional buffers 124*b* may be lower than buffer 124, so as to define a gap $s_3$ between a surface 124" of additional buffers 124*b* and working member 205, wherein $s_3<s_1$.

It will be appreciated that, when the impact member 207 is excited under a multi-frequency skewed vibration, the variation in buffer heights causes a corresponding variation in the time of collision between the impact member 207 and working member 205. Use of buffers with different heights thus enables a user to adjust the force-displacement curve of the restoring system, thereby to provide a greater built-in flexibility in the nonlinear characteristic of the dynamic system of the adapter unit of the invention. It will be appreciated by persons skilled in the art that this force displacement curve is the graph of the restoring force exerted by the buffer, versus displacement of the working member relative to the impact member, and is an important characteristic of the non-linear oscillation system embodied by the present invention.

Furthermore, a desired output frequency spectrum can be received in accordance with the provision of a selected number of additional buffers, their positions, stiffness and relative heights. Additional buffers such as these can be provided in conjunction with any of the buffers, whether these to be the upper or lower buffers, or to the side buffers 224' and 224" shown in FIGS. 5 and 6.

Figure 10:
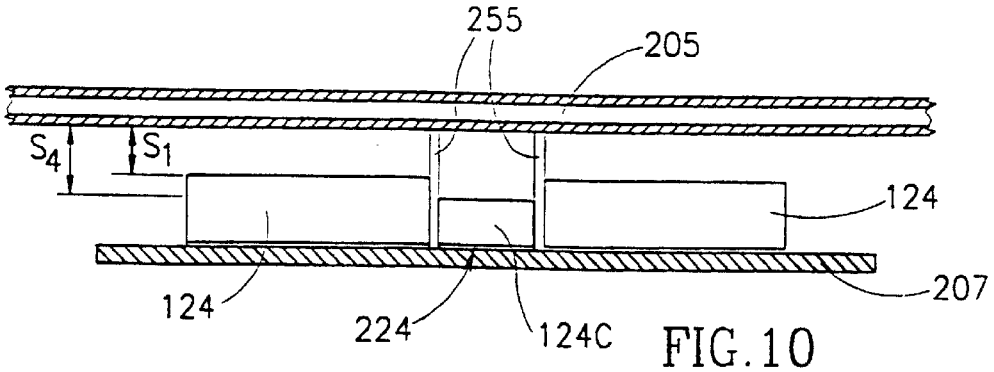
FIG. 10 is a cross-sectional view of an elastic buffer having a cavity in which is placed an additional buffer.
Figure 11:
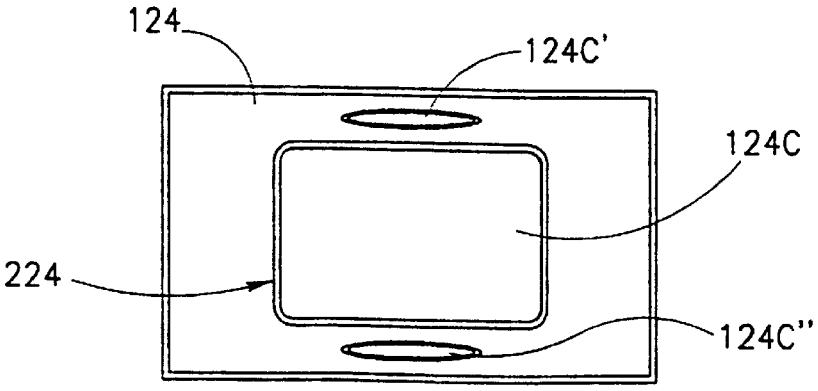
FIG. 11 is the top view on the buffer with the cut off cavities and additional buffers inside the cavities.

Referring now to FIGS. 10 and 11, in accordance with a further embodiment of the invention, it is also possible to provide one or more additional buffers 124*c*, 124*c*′ and 124*c*″ in a cavity or recess 224 of upper buffer 124. Cavity 224 may be any shaped cavity, such as any cavity or recess shown in any of FIGS. 8A–8C. These additional buffers preferably have a shape which corresponds to the shape of the appropriate cavity or recess, but may have define side gaps 255 with buffer 124 or have a predetermined height different to that of buffer 124. These differences in shape produce a known adjustment in the characteristics of collision between impact member 207 and working member 205, as described above in conjunction with FIGS. 9A and 9B.

Referring now generally to FIGS. 12A–14, it is also feasible to provide various non-pre-compressed elastic means for resilient support of the impact member 407 in relative motion to a working member 405, having stiffness characteristics similar to those described above in conjunction with elastic shear elements 109 and 110.

Figure 12A:
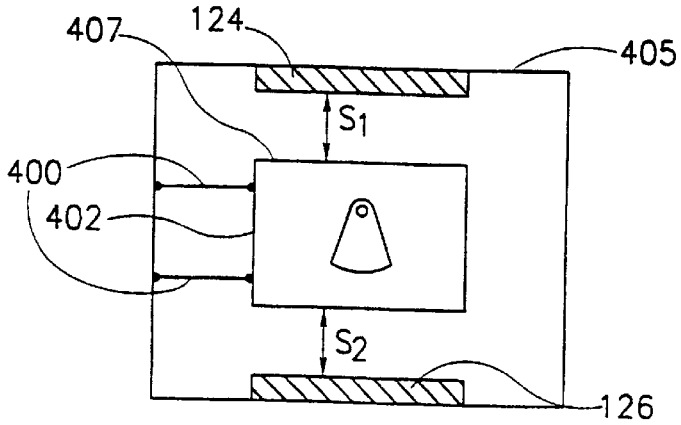
FIGS. 12A–12G are schematic side views vibrator adapter units employing various non-pre-compressed means, in accordance with alternative embodiments of the invention.
Figure 12B:
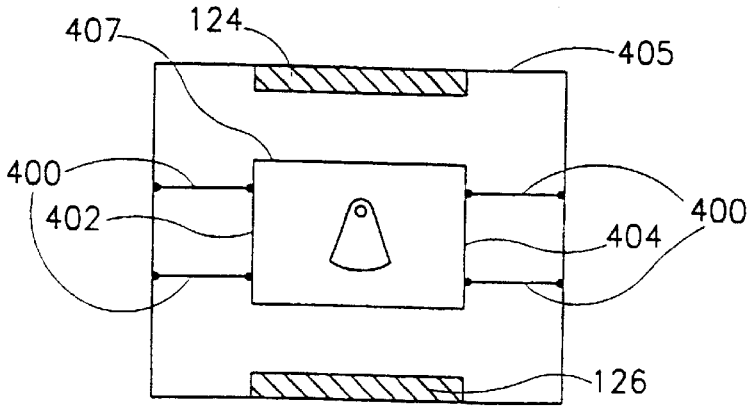
Figure 12C:
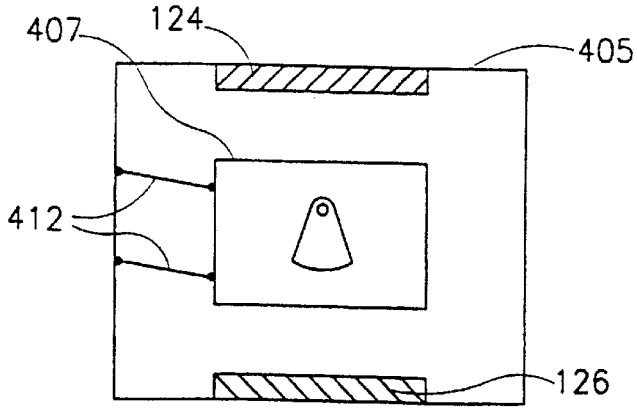
Figure 12D:
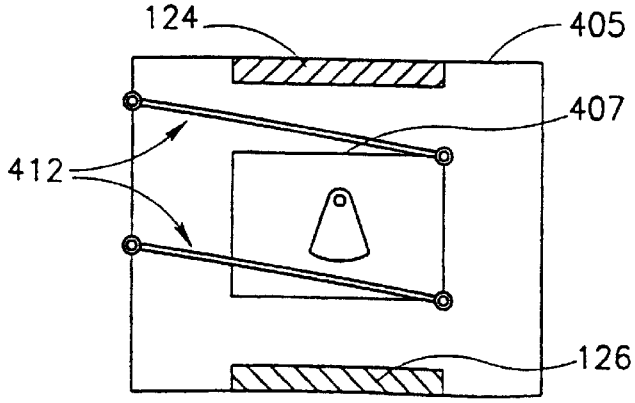
Figure 12E:
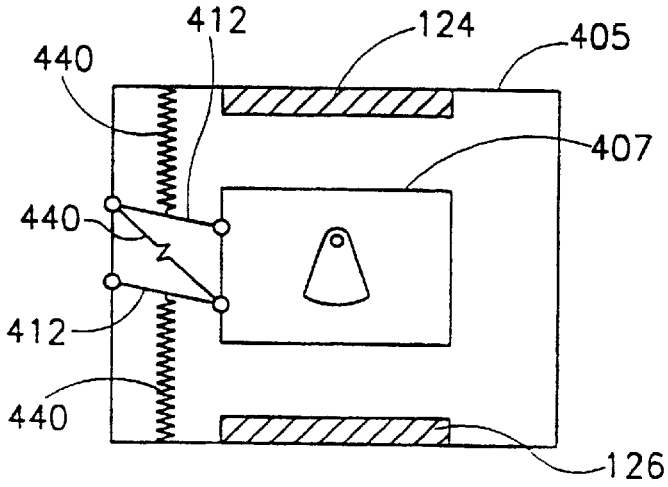

It is thus envisaged to provide a resilient supporting system by use of parallel leaf springs 400 which may connect one side 402 of an impact member 407 to working member 405, as seen in FIG. 12A. Alternatively, there may be provided parallel leaf springs to connect opposite sides 402 and 404 of impact member 407 to working member 405, as seen in FIG. 12B.

Alternatively, silent block arms or torsion arms may be used as resilient elements 412 in FIGS. 12C, 12D, 12D, 12F and 12G, either alone or in combination with other resilient means.

Figure 12F:
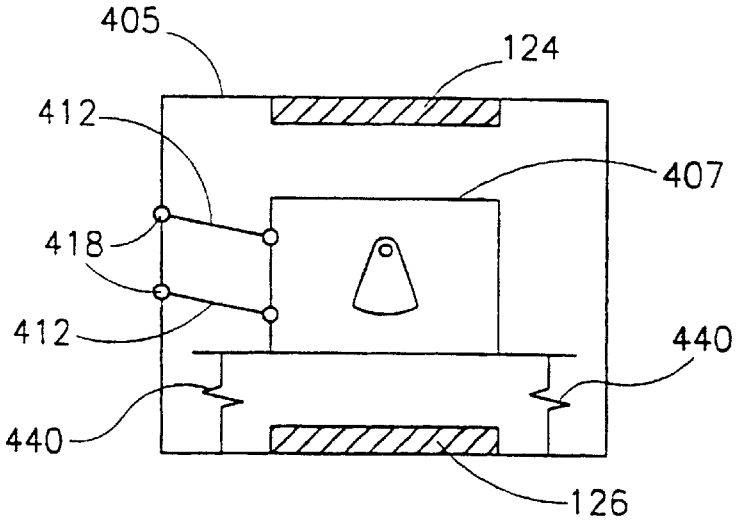
Figure 12G:
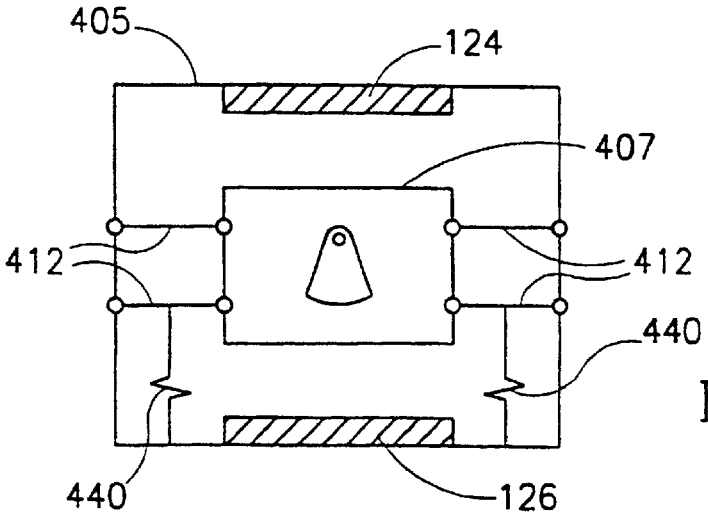

In order to provide a necessary stiffness of the resilient means, which may be important for certain applications, additional elastic elements 440 of any suitable type, as seen in FIGS. 12F and 12G, may be provided, between impact element 40 and working member 405. They may be placed in any suitable position between impact member 407 and working member 405, and may have any suitable geometric shape, or be formed of any suitable materials such as metal, rubber and so on, in accordance with predetermined requirements.

The use of any of the above-described resilient means in place of pre-compressed rubber blocks provides for increased reliability, a reduction in weight and cost, and an increase in performance due to a large normal/transverse stiffness ratio.

Referring now to FIGS. 13A, 13B and 13C, in accordance with yet a further embodiment of the invention, there are provided vibrator units which employ at least one elastic hinge 419, preferably a "silent-block" or a rubber-metal hinge, which connects between the impact member 407 and the working member 405. There are also provided preferably three buffers, referenced 424, 426 and 427, each of which may be provided with or without gaps, as described in conjunction with any of the preceding embodiments. The illustrated arrangements provide periodic or chaotic pulsed interaction between impact member 407 and working member 405. The pulsed or chaotic forces are applied with respect to lever arms about the hinge 419.

Impact member 407 may have any suitable shape and, by way of example only, may be in the form of a simple, linear member, as seen in FIG. 13C, it may be cranked or bent, as seen in FIG. 13B, or it may have a closed cross-sectional form in a plane normal to the hinge axis, such as triangular, as seen in FIG. 13A. In these arrangements, the working member 405 of the vibrator units (and thus also the working units of vibratory machines driven by the illustrated units) are subjected to multi-frequency excitation, which includes both multifrequency pulsed forces and multifrequency moments. It will be appreciated that by varying the centrifugal forces, buffer gaps (as described above in conjunction with FIGS. (8A–11), and the overall geometry of the system, it is possible to receive a wide range of relative phase between the above-mentioned forces and moments. This type of varied, complex multifrequency excitation as provided by any of the above units, is useful for optimum excitation of devices for blending and grinding of intricately shaped parts.

It will further be appreciated that each of the embodiments of FIGS. 13A–13C provides a particular relation between lever arm, impact pulse direction, and pulse moments.

Referring now particularly to the embodiments of FIGS. 13B and 13C, it is further seen that impact member 407 have attached thereto additional counterweights 444. The positions of counterweights 444 may be adjusted along the impact members 407 relative to hinge 419, thus causing a corresponding adjustment of the excitation forces and moments.

Referring now briefly to FIG. 13A, the triangular construction of the illustrated vibrator unit includes elastic elements 421' and 421" which allow relatively stiff elastic support of impact member 407, regardless of the orientation of the vibrator unit. The embodiment of FIG. 13A further includes an additional hinge 419'. Additional hinge 419' connects working member 405 to a member 291 of a vibratable working unit that it is sought to vibrate. As additional hinge 419' is coaxial with elastic hinge 419, the vibrator unit applies excitation forces to vibrating member 291 in either of planes 437' or 437". This arrangement provides for excitation of member 291 in both a forward direction, as shown by the arrow in solid lines, or in a reverse direction, as shown by the arrow in outline.

Figure 14A:
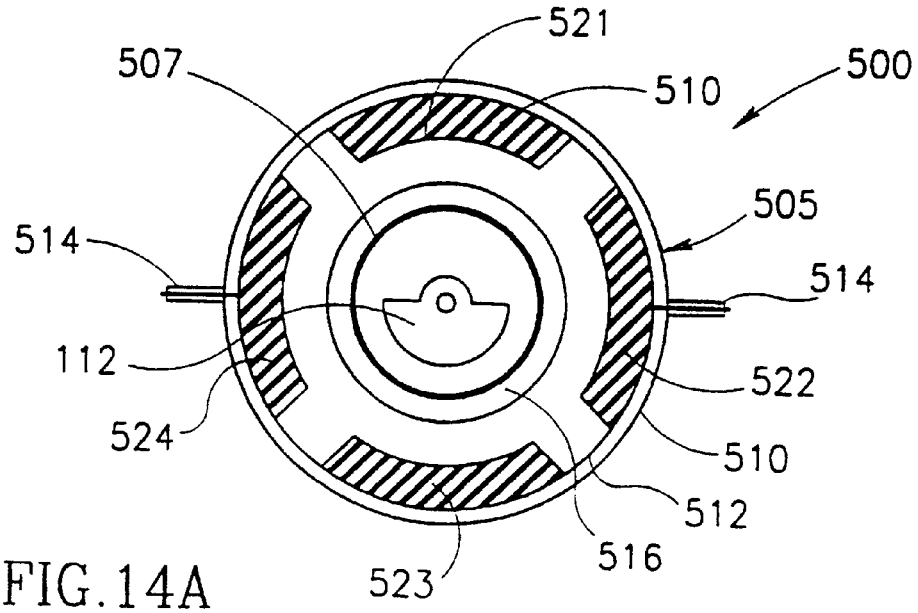
FIGS. 14A and 14B are cross-sectional views of vibrator units constructed in accordance with the present invention, in which a base member and impact member have round and oval cross-sectional shapes, respectively.
Figure 14B:
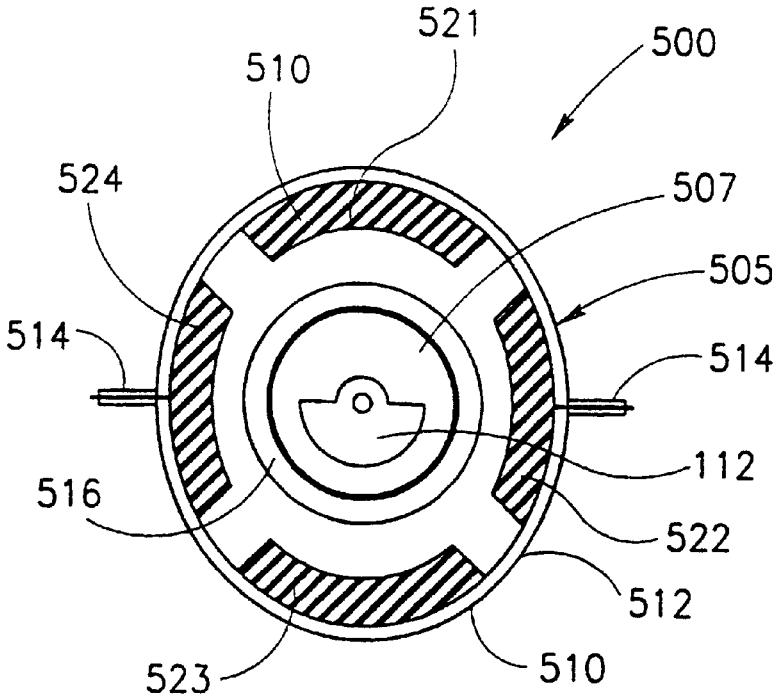

Referring now to FIGS. 14A and 14B, as yet a further alternative, there may also be provided a vibrator unit 500 which functions in accordance with the principles described above for unit 100, but which has a generally round (FIG. 14A) or oval (FIG. 14B) cross-sectional configuration, thereby to randomize oscillation under less excitation and to broaden the generated multi-frequency spectrum. In accordance with the present embodiment, working member 505 and impact member 507 are shaped in oval or round shape and the working member 505 includes cut segmental portions 510 with arc-shaped metal ties 512 and spacers 514. Spacers 514 are provided so as to facilitate adjustment of the gaps between buffers 521, 522, 523 and 524 and impact member 507, wherein the buffers are formed so as to have shapes corresponding to the segmental portions 510. Elastic means are provided in the form of rings 516, and may be made, by way of example, form a suitable elastomer. Rings 516 are operative, as shown, to connect between the impact member 507 and the working member 505, and they have predetermined radial and axial stiffness so as to provide a suitably tuned system. It will be appreciated that, in the embodiments of FIGS. 14A and 14B, the impact member 507 undergoes forced oscillations by means of unbalanced weight 112.

It will be appreciated by persons skilled in the art that the scope of the present invention is not limited to what has been shown and described hereinabove, merely by way of example. Rather, the scope of the present invention is defined solely by the claims, which follow.

We claim:

1. An integrated vibratory adapter device for providing multi-frequency oscillation of a vibratable working unit, which includes:

a working member associated with the working unit so as to be in force transmissive relation therewith;

centrifugal vibratory apparatus for generating a single frequency sinusoidal vibration;

rigid impact apparatus arranged to receive a single frequency sinusoidal vibration from said vibratory apparatus;

resilient mounting apparatus for mounting said rigid impact apparatus in motion transmitting association with said working member and which is operative, when said vibratory apparatus is operated, so as to vibrate said rigid impact apparatus such that it transmits vibration forces to said working member; and at least one elastic buffer apparatus disposed on said working member and spaced from said rigid impact apparatus to form a gap such that, when said vibratory apparatus is operated, said rigid impact apparatus elastically strikes said working member through said elastic buffer apparatus such that said rigid impact apparatus transmits a continuous sequence of mechanical shock pulses to the working member, so as to cause multi-frequency oscillation thereof, thereby also to cause multi-frequency oscillation of the working unit.

2. An adapter device according to claim 1, wherein said rigid impact apparatus includes a generally planar rigid impact portion, and wherein said resilient mounting apparatus includes apparatus for mounting said rigid impact apparatus such that said planar rigid impact portion thereof is spaced apart from said working member, and wherein said buffer apparatus is arranged between said working member and said planar rigid impact portion so as to transfer oscillation forces from said impact apparatus to said working member.

3. An adapter device according to claim 2, wherein said vibratory apparatus is connected to said impact apparatus via a rigid housing which is operative to transfer single frequency sinusoidal vibrations to said impact apparatus.

4. An adapter device according to claim 3, wherein said working member forms part of a rigid base assembly having rigid wall portions extending transversely therefrom, and said resilient mounting apparatus includes at least a pair of resilient members located between and connected to said rigid wall portions and said rigid impact apparatus, so as to support said impact apparatus in a floating mounting relative to said working member so as to permit motion of said impact apparatus having generally forward and rearward components with respect to said working member.

5. An adapter device according to claim 4, wherein said resilient members are of predetermined stiffness which permits predetermined vibration of said impact apparatus, and wherein said adapter device further includes apparatus for preventing overheating of said resilient members.

6. An adapter device according to claim 5, wherein said impact apparatus is operative to impact said working member via said elastic buffer apparatus when moving in a direction having a generally forward motion component, and said impact apparatus is operative to move away from said working member when moving in a direction having a generally rearward motion component; and wherein said apparatus for preventing overheating includes apparatus for limiting rearward motion of said impact apparatus.

7. An adapter device according to claim 5, wherein said rigid base assembly further includes a base portion rigidly connected to said rigid wall portions and generally parallel to said working member, and said elastic buffer apparatus includes forward buffer apparatus, and wherein said apparatus for preventing overheating includes rearward elastic buffer apparatus arranged between said impact apparatus and said base portion for elastically limiting said rearward component of said impact apparatus.

8. An adapter device according to claim 4, wherein said pair of resilient members are operative to partially resist said forward and rearward motion components of said impact apparatus.

9. An adapter device according to claim 8, wherein said pair of resilient members are operative to resist said forward and rearward motion components of said impact apparatus in shear.

10. An adapter device according to claim 9, wherein said resilient members include precompressed elastic portions having a much lower stiffness in shear planes generally parallel to said forward and rearward motion components of said impact apparatus than normal thereto.

11. An adapter device according to claim 10, wherein the ratio of the stiffness of said resilient members along said shear planes to the stiffness of said resilient members in a direction normal thereto is less than 1/20.

12. An adapter device according to claim 10, wherein said base assembly has formed in one of said rigid wall portions an opening permitting insertion and removal therethrough of one of said elastic portions, and further includes cover apparatus fastenable to said one wall portion for closing said opening, thereby also to compress said one elastic portion.

13. An adapter device according to claim 1, wherein said elastic buffer apparatus includes a generally planar portion of a resilient material.

14. An adapter device according to claim 13, wherein said elastic buffer apparatus has a generally uniform thickness.

15. An adapter device according to claim 1, wherein said elastic buffer apparatus includes at least one portion of a resilient material and is of varying thickness.

16. An adapter device according to claim 1, wherein said working member is configured to generally surround said impact apparatus, and wherein said resilient mounting apparatus includes apparatus for mounting said rigid impact apparatus so as to be spaced apart from said working member.

* * * * *